United States Patent [19]

Horning

[11] 4,030,528

[45] June 21, 1977

[54] MAGAZINE FOR BAGS SUCH AS SACKS

[75] Inventor: Bent Horning, Copenhagen Valby, Denmark

[73] Assignee: F. L. Smidth & Co., Cresskill, N.J.

[22] Filed: Oct. 28, 1975

[21] Appl. No.: 626,479

[30] Foreign Application Priority Data

Oct. 28, 1974 United Kingdom ..... 46449/74

[52] U.S. Cl. ..... 141/1; 141/114; 214/6 BA; 214/6 TS; 214/8.5 A; 214/8.5 H

[51] Int. Cl.[2] ..... B65B 3/00

[58] Field of Search ..... 141/10, 67, 68, 114, 141/1, 313–317; 53/188, 190, 386, 384, 385; 214/6 BA, 6 TS, 8.5 A, 8.5 H, 8.5 C

[56] References Cited

UNITED STATES PATENTS

| | | | |
|---|---|---|---|
| 2,510,212 | 6/1950 | Donnell | 141/1 |
| 3,715,858 | 2/1973 | Durant et al. | 141/68 |

FOREIGN PATENTS OR APPLICATIONS

| | | | |
|---|---|---|---|
| 63/526 | 8/1963 | South Africa | 141/1 |
| 350,165 | 6/1931 | United Kingdom | 141/1 |

*Primary Examiner*—Houston S. Bell, Jr.
*Attorney, Agent, or Firm*—Pennie & Edmonds

[57] ABSTRACT

An apparatus is disclosed for transferring valved bags such as cement sacks from a first supply position to a second position whereby they are removed by filling spouts of an associated packing apparatus. First bag transporting means in the form of a conveyor belt has a bag receiving position and a bag discharging position and is adapted to successively move bundles of the bags from the bag receiving position to its discharge position. Second bag transporting means such as a second conveyor belt is positioned adjacent the first transporting means and adapted to successively receive bundles of the bags discharged from the first transporting means and to position the bags so received in a generally upright stacked relation. Means for detecting deviations of the height of the stack of bags from a predetermined level resulting from successive removal of each uppermost bag from the stack by filling spouts of the associated packing apparatus, supplies a signal activating the second transporting means when the height of the stack of bags reaches a pre-set level. When the second bag transporting means reaches a predetermined bag receiving position the first bag transporting means is activated until a bag, or bundle of bags, arrives at a pre-set bag discharge position, and means to transfer the bags from the first transporting means to the second transporting means maintains the height of the stack of bags at a predetermined level so as to receive the filling spouts and be removed thereby. A unique method for handling such bags on the inventive apparatus is also disclosed.

25 Claims, 5 Drawing Figures

MAGAZINE FOR BAGS SUCH AS SACKS

BACKGROUND OF THE INVENTION

1. Field of the Invention

This invention relates to an apparatus for automatically handling bags such as sacks which are to be picked up successively by filling spouts. The invention also relates to a method for handling such bags on the inventive apparatus.

2. Description of the Prior Art

In both rotary and stationary packing machines the sack magazines associated therewith have hitherto been filed with empty valved sacks by hand, regardless of whether the sacks are afterwards placed on the filling spouts of the packer by hand or automatically. For this purpose the empty sacks have been supplied in bundles of, for example, 50 sacks which the operators of the packer place in the sack magazine. When the placing of sacks on the filling spout is manully accomplished, filling of the sack magazine from a pallet stack — which in its simplest form may be a table or the like — on which sacks have been stacked, comprises one of the natural tasks of the operator. In more modern packing machines provided with automatic means for placing sacks on the filling spouts of the packer, it has hitherto been necessary to provide an operator at the machine to fill the sack magazine. In these cases the magazine is often formed as a type of cassette with special means for advancing the sacks to the position in which they are picked up automatically after having been placed in the magazine.

British Pat. No. 350,165 relates to an apparatus for lessening breakage, noise and dust at the discharge point of conveyors. The apparatus consists of an endless belt which is passed over two or more pulleys or wheels, the belt being so arranged that it makes contact with materials being carried on an associated conveyor as the materials reach the discharge point of the conveyor belt. This prevents the material from falling a substantial distance before reaching a contact point thereby substantially decreasing breakage, dust, and noise at the discharge location of the associated conveyor belt.

U.S. Pat. No. 2,510,212 to Donnell relates to a bucket type conveyor mechanism. The apparatus consists of a flexible endless belt with a plurality of compartments located thereon with the sidewalls thereof mounted so that the bottom edges conform to the configuration of the belt.

South African Pat. No. 63/526 relates to a conveyor belt having side walls and adjustable cross walls.

According to my invention a self-filling sack magazine is provided which renders manual operation at the packer itself superfluous. The vicinity of such a machine is not an attractive working place due to the dust nuisance. A magazine is provided for feeding empty sacks, of the type having a mouth with or forming part of a valve which are to be automatically placed one by one on the filling spouts of an automatic packing machine so as to be filled with powder material such as cement.

SUMMARY OF THE INVENTION

The invention relates to an apparatus for transferring bags such as sacks from a first supply position to a second position for removal thereof by filling spouts of a packing apparatus. The apparatus comprises first bag transporting means having a bag receiving position and a bag discharging position, said transporting means being adapted to move at least one bag from the receiving position to the bag discharging position. The invention further comprises second bag transporting means positioned adjacent the first bag transporting means and adapted to successively receive at least one bag discharged from the first bag transporting means and to position the bags so received in generally upright stacked relation. The invention further comprises means for detecting deviations of the height of the stack of bags so formed, resulting from the successive removal of each uppermost bag from said stack by filling spouts associated with an associated packing means and capable of supplying a signal which activates the second conveying means when the height of the stack of bags reaches a predetermined minimum level relative to the second transporting means. The invention further comprises means for activating the first bag transporting means when the second bag transporting means reaches a predetermined bag receiving position at least until the first transporting means transports at least one bag to a predetermined discharge position. The invention further comprises means to transfer at least one bag from the first bag transporting means to the second bag transporting means when the first and second bag transporting means are in their respective bag discharging and bag receiving positions and to thereby maintain the height of the stack of bags on the second bag transporting means at predetermined levels required for reception of the filling spouts and removal of the bags.

In its preferred form the present invention relates to a magazine provided for feeding empty sacks, of the types having a mouth with or forming part of a valve, to an automatic sack-filling machine, the magazine comprising a first substantially horizontal endless conveyor, and a second upright endless conveyor having a number of transverse supporting walls equidistantly arranged along its length. This arrangement, provides a stack of sacks to be fed to the automatic filling machine, means being provided for transferring sacks from the first to the second conveyor as well as means for controlling the movement of the first conveyor and transfer means in response to movement of the second conveyor.

Preferably, the substantially horizontal conveyor also includes a number of transverse supporting walls equidistantly arranged along its length and has a length sufficient to supply the requirements of the automatic filling machine for a long period, for example half a day.

The method of the invention relates to transferring bags such as sacks from a first supply position to a second position for removal thereof by filling spouts of a packing apparatus. The method comprises placing at least one bag on a first bag transporting means having a bag receiving position and a bag discharging position. The method further comprises moving at least one bag on the first bag transporting means to the bag discharging position and transferring at least one bag from the discharging position of the first bag transporting means to a second bag transporting means when said second bag transporting means is in bag receiving position. The method further comprises positioning said bags so received in generally upright stacked relation and detecting deviations of the height of the stack of bags so formed which results from the successive removal of each uppermost bag from the sack by filling spouts associated with an associated packing means. The method further comprises activating said second bag transporting means in response to a signal transmitted by the means for detecting any deviation in the height of the stack, and activating the first bag transporting means so that a bag is moved to the discharge position in dependent response to the assumption by the second bag transporting means of a predetermined bag receiving position.

In its preferred form, the invention pertains to a method of filling sacks, of the kind described above, with granular or powdered material. The method comprises the steps of moving a number of sacks along a substantially horizontal conveyor and transferring the sacks to an upright conveyor along which the sacks are then moved to a machine which fills the sacks. Movement of the horizontal conveyor and the transfer of sacks from the horizontal conveyor to the upright conveyor are both controlled in response to movement of the upright conveyor to a bag receiving position. Preferably operation of the two conveyors is controlled through an automatic regulating mechanism which registers the position of the uppermost, foremost sack on the second conveyor in relation to its proper position for being picked and subsequently placed on the packer. This automatic regulation and control is provided by means of an electric circuit between the two conveyors which operates in a manner such that said first and second conveyors move forwardly and/or upwardly in response to the removal of sacks from the upright conveyor by the automatic sack-filling machine and in response to the transfer of a bundle of sacks from the horizontal conveyor either to the lowermost or to the uppermost end of the upright conveyor as the upright conveyor is emptied from above.

For transfer to the lowermost end of the upright conveyor the horizontal conveyor has at its end nearer to the upright conveyor an automatic pushing mechanism for the transfer of the bundles of sacks from the horizontal to the vertical conveyor band. The pushing mechanism acts on the bundles when the supporting walls of each of the two conveyors are in a horizontal position opposite each other. For transfer to the uppermost end of the upright conveyor the horizontal conveyor is placed somewhat higher in relation to the upper end of the upright conveyor so that the bundles of sacks, by gravity, slide off the supporting walls of the horizontal conveyor as the walls turn round the end of this conveyor which is nearer to the upright conveyor. The bundles then move down via a skid or a roll mechanism onto the supporting walls of the upright conveyor located on the down-moving side of the upright conveyor. The conveyor then transports the bundles onto a U-shaped path downwards, round the lower end of the conveyor and upwards to the position from which the sacks are picked by the packing machine. A screen which may be in the form of a flexible, movable band resting partly on rolls, and partly against the outer ends of the supporting walls of the upright conveyor, may surround the lower end of the upright conveyor thus preventing the bundles of sacks from sliding from the supporting walls of the conveyor.

BRIEF DESCRIPTION OF THE DRAWINGS

Preferred embodiments of the invention are described hereinbelow with reference to the accompanying drawings wherein.

DETAILED DESCRIPTION OF THE PREFERRED EMBODIMENTS

In the following it should be understood that the term "sacks" encompasses bags, sacks, or equivalent material carrying means.

Figure 1:
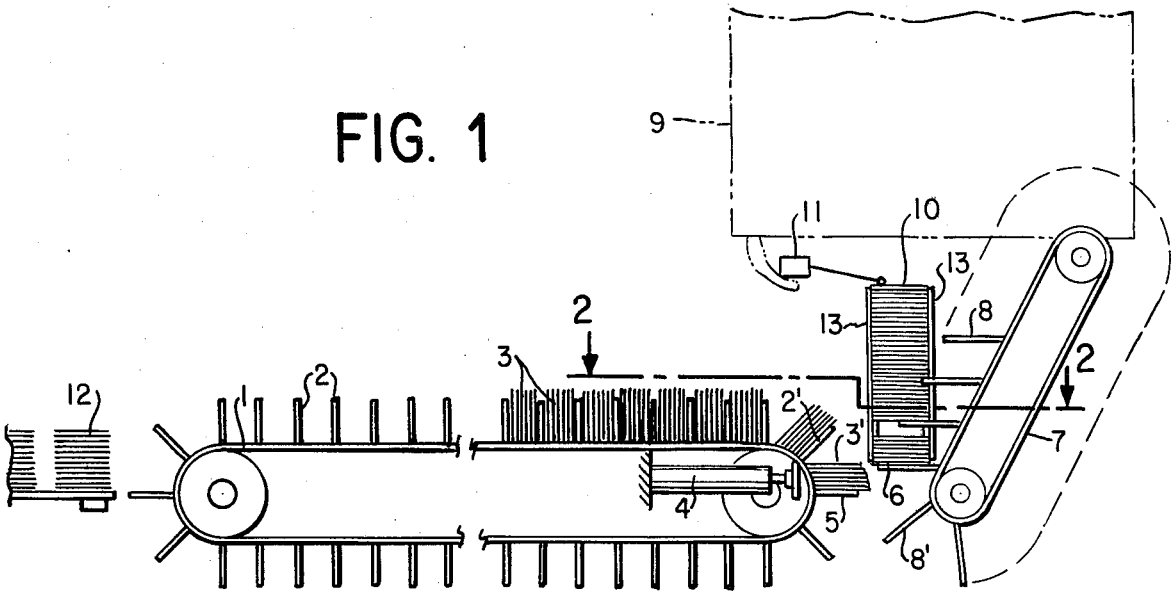
FIG. 1 is a side view showing a pallel stock, a magazine for sacks and a packer.

FIG. 1 illustrates a horizontal conveyor belt 1 and an upright conveyor belt 7. Bundles of sacks 3 are placed on the horizontal belt in an upright position as shown between supports 2. Supports 2 may be of metal, plastic or other non-metallic material and are positioned on conveyor belt 1 as shown. The bundles of sacks are transferred while in a lying position 6 onto lifting plates 8, 8′, likewise composed of metal, plastic or other non-metallic material and which are located on the upright conveyor belt 7. An automtic pushing mechanism 4 transfers bundles of sacks from the horizontal belt to the upright belt. This mechanism will be described in more detail below. The conveyor belts 1 and 7, their corresponding driving mechanisms, the supports 2 and the lifting plates 8, 8′ are all of a conventional type. A rotary or stationary packing machine 9 is shown diagrammatically and has automatic means (not shown) for picking the sacks from that part of the sack magazine which is constituted by the sack bundles 6 on the upright conveyor belt 7.

An automatic regulating mechanism 11 registers the level at which the uppermost sack 10 is located in the magazine. The regulating mechanism automatically starts and stops the conveyor belt 7 via an electric circuit. A pallett stock 12 is provided from which the bundles of sacks may be transferred manually or mechanically to the horizontal conveyor band.

Figure 2:
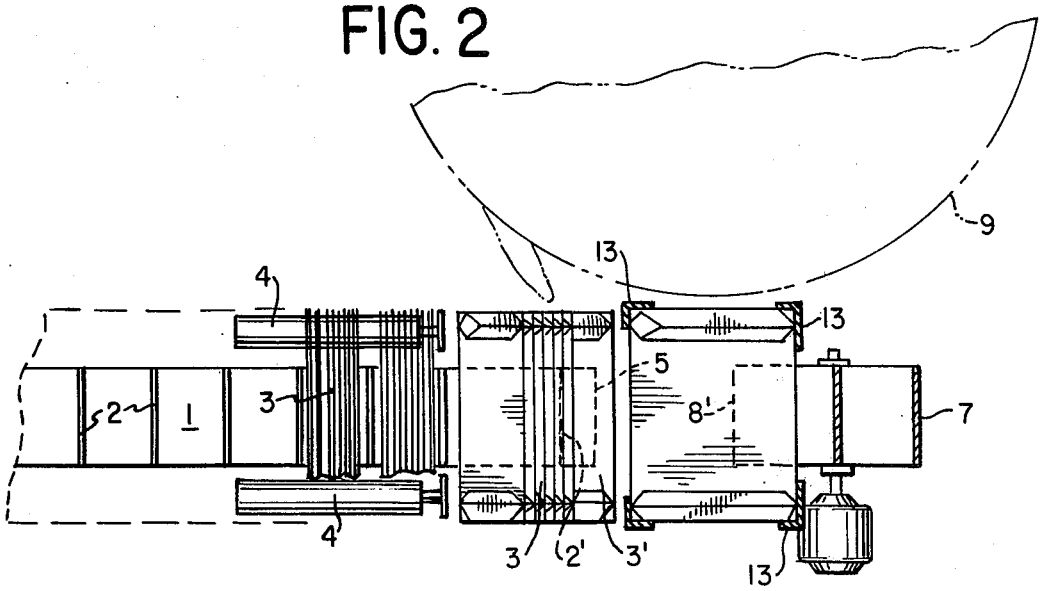
FIG. 2 is a partial cross sectional view taken along the line 2—2 of FIG. 1 showing the automatic pushing mechanism for the transfer of the bundles of sacks from the horizontal conveyor band to the vertical conveyor band.

Referring now to FIG. 2, components corresponding to those components of FIG. 1 are identified by like reference numerals. The horizontal conveyor belt is shown at 1 with supports 2 arranged transversely of the direction of movement of the band and retaining the sack bundles 3 in their proper position on the band. Changes in the position of the supports from a vertical to a horizontal position during the movement of the conveyor belt are shown at FIG. 2 with numerals 2, 2′ and 5 designating the changed positions. A bundle of sacks 3′ lying on the support 5 in horizontal position are also shown together with a pushing mechanism consisting of two pneumatically or hydraulically driven pistons in closed cylinders 4. When a bundle of sacks on the belt 1 is advanced to a position in which the bundle is lying on the support in position 5, the mechanism 4 will automatically push the bundle onto the corresponding horizontal plate 8 of the conveyor 7. The two conveyors are controlled by an electric control system (not shown) which activates the horizontal belt 1 and the pushing mechanism synchronously with the passing of an empty plate 8' of the conveyor 7 into its receiving position opposite the horizontal belt 1 so that a bundle of sacks may be transferred thereto.

The height of the transverse supports 2 of the belt 1 is limited by the operating capabilities of the pushing mechanism 4 as indicated in FIG. 2. Since the sacks contemplated herein are of the type having a relatively thick valve portion at one end and a relatively thick opposite bottom end portion, when these sacks are placed in stacked relation these end portions of the uppermost sack will curve upwardly and inwardly and this curvature will present difficulties in automatically removing the sack from the magazine. Therefore it is a prerequisite that the length of the carrying surface of the plates 8, 8' positioned on the upright band 7 be less than the length of the bundles of sacks lying on the plate. Because of this dimensional relation the thickened portions at the valve end portions of the empty sacks and the bottom end portions thereof will have an overhanging extension on either side of the plate, and this overhang will enable the uppermost sack 10 to form an approximately horizontal flat surface which ensures automatic removal of the uppermost sack from the magazine. The upright conveyor 7 may, s indicated in FIG. 1 also be arranged such that during the upward movement the plates 8, 8' are gradually withdrawn from the stack formed by the sack bundles 6. Alongside the stack a shaft or cassette is formed by walls 13 between which the sacks slide.

The self-filling sack magazine shown in FIGS. 1 and 2 operates as follows: Prior to the start of the automatic packer 9, the horizontal belt 1, is filled with bundles of sacks 3, from a pallet stock. The band is of substantial length corresponding for example to the requirement of a whole or a half working day at the packer involved (i.e., 8000–30000 sacks). When the horizontal conveyor 1 has been filled up both belts are advanced until the stack of bags retained in position by the vertical conveyor band has reached the level at which the uppermost sack 10 may be picked-up by the automatic sack-placing mechanism. The level is registered by the mechanism 11, which stops the band 7, and consequently also the band 1, at the predetermined level.

When the packer and the automatic sack-placing mechanism are subsequently started and the picking of sacks from the top of the magazine is commenced, the regulating mechanism will register a drop in the level of the stack of sacks on the belt 7 and will activate the upright conveyor 7 in order to maintain the required height of the stack. When the belt 7 has advanced so much as to leave room for a new bundle of sacks at the bottom of the stack of sacks, the control mechanism between the two belts will activate the belt 1 and the pushing mechanism 4 transfers a fresh bundle of sacks from the horizontal belt to the lowermost end of the upright conveyor. In case there are empty spaces between the supports of the horizontal belt, the control mechanism will automatically ensure that the horizontal belt continues running until a successive bundle of sacks is in its proper position for transfer by means of the pushing mechanism.

Figure 3:
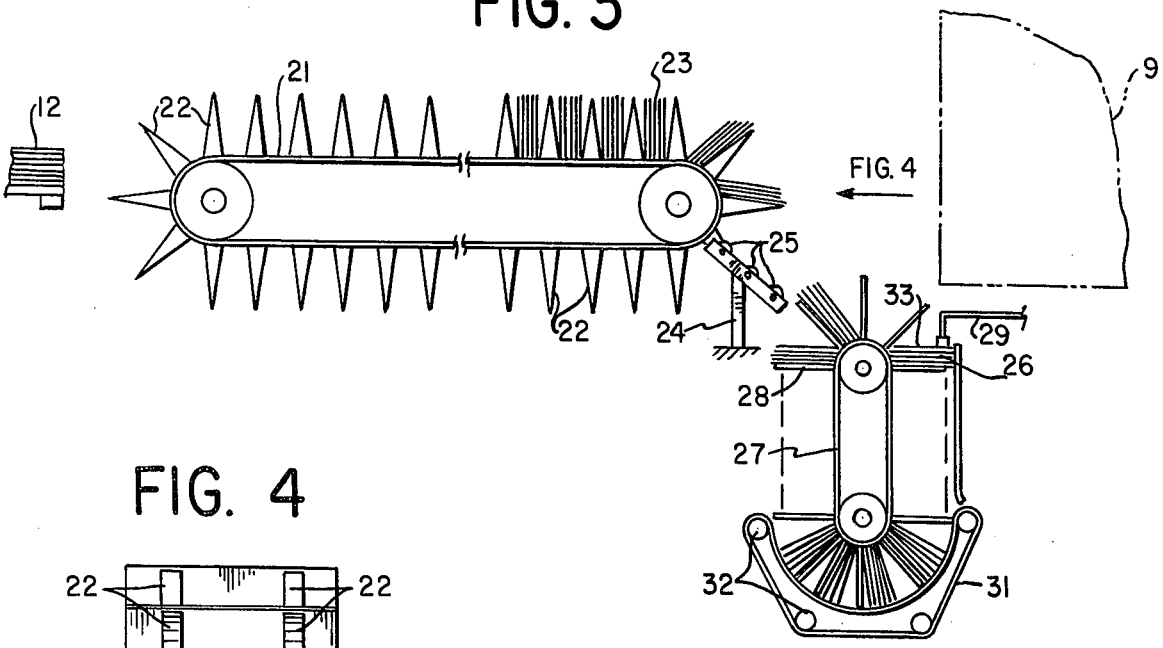
FIG. 3 is a side view illustrating an alternate embodiment of the invention, wherein bundles of sacks are transferred to the uppermost end of an upright conveyor.
Figure 5:
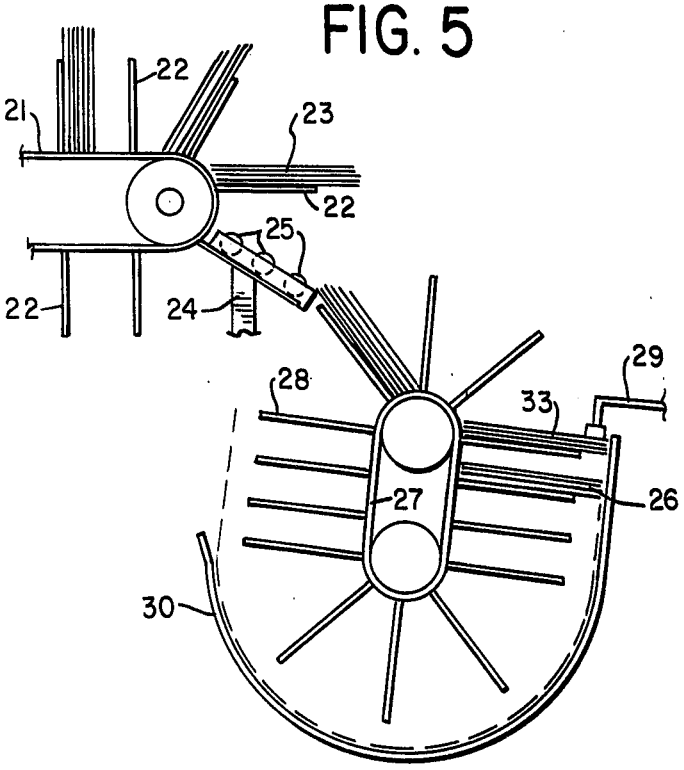
FIG. 5 is a more detailed view of portion 5 of the apparatus illustrated in FIG. 3.

FIG. 3 illustrates an alternate embodiment of the packing machine 9 shown in FIG. 1. The pallet stock 12 (also shown in FIG. 1) as well as a horizontal conveyor 21 and upright conveyor 27 are also illustrated. Supporting walls 22 of the horizontal conveyor are shaped in such a manner that the bundles of sacks 23 are squeezed during horizontal movement into fixed positions between neighboring walls. A skid or a roll mechanism 25 is provided to assist in transferring bundles which have passed around the discharge end of the horizontal conveyor 21 and which have been released from the horizontal conveyor 21. The skid or roll mechanism 25 is held in position by support 24. After being transferred to plates 28 of the upright conveyor the sack bundles 26 are moved in a downward direction, around the lower end of the upright conveyor and then upwards until the uppermost sack of the stack reaches position 33, as shown in FIG. 3 and FIG. 5, where said uppermost sack is removed automatically by means, not shown, of the packing machine. An automatic regulating mechanism 29 is provided for registering the level of the uppermost sack 33. A flexible, movable band 31 is positioned to prevent the sack bundles from falling off the conveyor 27 during passage of the bundles around the lower end of said conveyor. The band rests in part on rolls 32 and in part on plates 28 and may be rotated by and synchronized with the driving mechanism of the upright conveyor 27.

Figure 4:
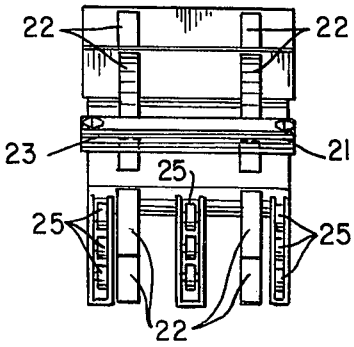
FIG. 4 is a side view of the right end of the horizontal conveyor in FIG. 3 as viewed along the arrow labeled "FIG. 4" of FIG. 3.

In FIG. 4 details of the discharge end of the horizontal conveyor are illustrated including a view taken along lines 4—4 of FIG. 3 showing the conveyor 21, the skid or roll mechanism 25, and supporting walls 22.

FIG. 5 illustrates the sack pick up position 33. The movable band 31 illustrated in FIG. 3 and described above is replaced by a screen 30 for preventing the sack bundles from falling off the conveyor during passage around the lowermost end. Apart from the transfer of the sack bundles by means of the pushing mechanism the operation principles of the sack magazine shown in FIGS. 3–5 are the same as those of the sack magazine shown in FIGS. 1 and 2, and which are described above.

The invention is not limited to the conveyor belts described and to their arrangement and direction of rotation in relation to each other, but may comprise several conveyor belts acting as parts of the whole sack magazine and if necessary having different gradients to one another. Of these belts, however, the one directly opposite the packer must always be capable of advancing the sacks in such a manner that an upright stack of sacks is formed and that the foremost sack can be picked up by an automatic sack-placing mechanism. Likewise, a belt feeding the upright belt must be substantially horizontal.

I claim:

1. An apparatus for transferring bags such as sacks from a first supply position to a second position whereby the bags are positioned in stacked relation for successive removal of a foremost bag by filling spouts of a packing apparatus which comprises:

a. first bag transporting means having a bag receiving position and a bag discharging position for transferring at least one bag at least from said bag receiving position to said bag discharging position;

b. means associated with said first bag transporting means for supporting said at least one bag on said first bag transporting means;

c. second bag transporting means positioned adjacent the bag discharging position of said first bag transporting means;

d. means associated with said second bag transporting means for successively receiving and supporting bundles comprising at least one bag discharged from the bag discharging position of said first bag transporting means when said second bag transporting means assumes a bag receiving position, and for maintaining the bags received in stacked relation;

e. means for monitoring the position relative to said filling spouts of the foremost bag of said stack of bags and to activate said second bag transporting means in response to a signal provided when the position of the foremost bag is without a predetermined range due to the successive removal of each foremost bag from said stack;

f. means for activating said first bag transporting means when said bag receiving means associated with said second bag transporting means assumes a predetermined bag receiving position at least until said first transporting means transports at least one bag to said bag discharging position; and g. means to transfer at least one bag from said bag discharging position of said first bag transporting means to said bag receiving means associated with said second bag transporting means when said first and second transporting means are in bag discharging and receiving positions, respectively, to thereby maintain the position of the foremost bag at predetermined levels relative to the packing apparatus for reception of the filling spouts and removal thereby.

2. The apparatus according to claim 1 wherein said discharge portion of said first bag transporting means is located at a higher level than the bag receiving position of said second bag transporting means.

3. The apparatus according to claim 1 wherein said first bag transporting means is a substantially horizontal conveyor band.

4. The apparatus according to claim 3 wherein said second bag transporting means is a substantially upright conveyor band.

5. The apparatus according to claim 3 wherein said horizontal conveyor band is provided with supporting devices for holding bags located thereon in a substantially upright condition.

6. The apparatus according to claim 4 wherein the substantially upright conveyor band is provided with support means positioned to receive bundles of sacks from the horizontal conveyor band and to advance the bundles in substantially upright stacked relationship in a manner such that each successive uppermost sack is located at a predetermined level that permits the sack to be removed by filling spouts of an associated packer.

7. The apparatus according to claim 1 wherein the means to transfer at least one bag from said first bag transporting means to said second bag transporting means is a pusher automatically operated when said first transporting means reaches a predetermined position.

8. The apparatus according to claim 2 wherein the means to transfer at least one bag from said first bag transporting means to said second bag transporting means is a roller means.

9. The apparatus according to claim 8 further comprising a holder means positioned adjacent a lower end portion of the upright bag conveying means in such manner as to retain the bags on the supporting means of the substantially upright conveyor belt while said supporting means pass around the lower end portion.

10. The apparatus according to claim 9 wherein the holder means is a flexible movable band positioned and configured to slide partly on adjacent rollers and to rest partly on the support means of the upright band and adapted to be rotated by and synchronized with a driving mechanism of the upright conveyor.

11. The apparatus according to claim 9 wherein the holder means is a screen positioned and configured to retain bags on the supporting means of the substantially upright conveyor belt while said support means pass around the lower portion of said upright bag conveying means.

12. An apparatus for transferring bags such as valved sacks from a first supply position to a second position whereby the bags are positioned in generally vertical stacked relation, said bags being configured to be removed by filling spouts of an automatic packer for filling with powdered material such as cement which comprises:

a. a first conveyor belt for transporting bags from a first receiving position to a second discharging position, said first conveyor belt having a bag receiving position adjacent a supply of bags and a bag discharging position;

b. a second conveyor belt positioned adjacent the discharging position of said first conveyor belt and oriented in a generally upright position for successively receiving and supporting bundles comprised of a predetermined number of bags from said first conveyor belt, means to receive said bundles of bags and to retain said bags in generally upright stacked relation;

c. means to monitor the height of said stack of bags and to detect deviations of the height of said stack from a predetermined level resulting from the successive removal of each uppermost bag from said stack by the filling spouts associated with the automatic packer and for generating a signal which activates said second conveyor belt when the height of said stack of bags is below a predetermined minimum level;

d. control means for activating said first conveyor belt toward the bag discharging position when said second conveyor belt reaches a predetermined bag receiving position and for maintaining the activation of said first conveyor belt until at least one of said bundles of bags thereon reaches a predetermined bag discharging position; and e. means to transfer at least one of said bundles of bags from said first conveyor belt to said second conveyor belt when said first and second conveyor belts are in bag discharging and receiving positions; respectively, to thereby maintain the height of said stack of bags of said second conveyor belt to predetermined levels for reception by the filling spouts of the automatic packer and removal of said bags by said filling spouts.

13. An apparatus for transferring bags such as valved sacks from a first supply position to a second position whereby the bags are positioned in stacked relation, said bags being configured to be removed by filling spouts of an automatic packer for filling with powdered material such as cement which comprises:

a. a first conveyor belt for transporting bags from a first receiving position to a second discharging position, said first conveyor belt having a bag receiving position adjacent a supply of bags and a bag discharging position;

b. a second conveyor belt positioned below said first conveyor belt having upper end and lower end portions and oriented in a generally upright position for successively receiving at said upper end portion bundles comprised of a predetermined number of bags from said first bag conveyor belt and for positioning said bundles of bags in generally upright stacked relation;

c. means to monitor the height of said stack of bags and to detect deviations of the height of said stack from a predetermined level resulting from the successive removal of each uppermost bag from said stack by the filling spouts associated with the automatic packer and for generating a signal which activates said second conveyor belt when the height of said stack of bags reaches a predetermined minimum level;

d. control means for activating said first conveyor belt toward the bag discharging position when said second conveyor belt reaches a predetermined bag receiving position and for maintaining the activation of said first conveyor belt until at least one of said bundles of bags thereon reaches a predetermined bag discharge position; and e. roller means positioned between said first conveyor belt and said second conveyor belt for transferring at least one bag from said first conveyor belt to said second conveyor belt when said first and second conveyor belts are in bag discharging and bag receiving positions, respectively.

14. An apparatus for transferring bags such as valved sacks from a first supply position to a second position whereby the bags are positioned in stacked relation, said bags being configured to be removed by filling spouts of an automatic packer for filling with powdered material such as cement which comprises:

a. a first generally horizontal conveyor belt for transporting bags from a first receiving position to a second discharging position, said first conveyor belt having a bag receiving position adjacent a supply of bags and a bag discharging position;

b. a second conveyor belt positioned adjacent said first conveyor belt and oriented in a generally upright position for successively receiving bundles comprised of a predetermined number of bags from said first conveyor belt and for positioning said bundles of bags in generally upright stacked relation;

c. means to monitor the height of said stack of bags and to detect deviations of the height of said stack from a predetermined level resulting from the successive removal of each uppermost bag from said stack by the filling spouts associated with the automatic packer and for generating a signal which activates said second conveyor belt when the height of said stack of bags reaches a predetermined minimum level;

d. control means for activating said first conveyor belt toward the bag discharging position when said second conveyor belt reaches a predetermined bag receiving position and for maintaining the activation of said first conveyor belt until at least one of said bundles of bags thereon reaches a predetermined bag discharging position; and e. transfer means comprising at least one of hydraulic and pneumatic cylinders positioned and adapted to automatically transfer at least one of said bundles of bags from said first conveyor belt to said second conveyor belt when said first and second conveyor belts are in bag discharging and receiving positions, respectively, to thereby maintain the height of said stack of bags of said second conveyor belt to predetermined levels for reception by the filling spouts of the automatic packer and removal of said bags by said filling spouts.

15. A method for stacking bags such as sacks by transferring bundles of said bags from a first supply position to a second position for successive removal by filling spouts traversing a generally arcuate path about an associated packing apparatus, each bundle including at least one bag, which comprises:

a. successively placing said bundles of bags on a first bag transporting means having a bag receiving position and a bag discharging position;

b. transferring said bundles of bags to the bag discharging position of said first bag transporting means;

c. successively transferring said bundles of bags from the discharging position of said first bag transporting means to a second bag transporting means when said second bag transporting means is in a predetermined bag receiving position;

d. positioning and supporting said bags by said second bag transporting means in generally upright stacked relation adjacent the arcuate path of said filling spouts for successive removal thereof by said filling spouts;

e. monitoring the position relative to said filling spouts of the foremost bag of said stack of bags;

f. activating said second bag transporting means in response to signals provided when the position of the foremost bag is without a predetermined range due to successive removal of each foremost bag from said stack; and g. activating said first bag transporting means to move at least one bundle comprising at least one bag to its bag discharging position in dependent response to the assumption by said second bag transporting means of a predetermined bag receiving position.

16. The method according to claim 15 further comprising positioning said first bag transporting means at a higher level than the bag receiving position of said second bag transporting means.

17. The method according to claim 15 further comprising moving said at least one bag located on said first bag transporting means on a substantially horizontal plane.

18. The method according to claim 15 further comprising moving bags located on said second bag transporting means in a substantially vertical plane.

19. The method according to claim 15 further comprising supporting the bags located on said first bag transporting means in an upright position.

20. The method according to claim 19 further comprising supporting the bags located on the second bag transporting means in upright stacked relationship in a manner such that each successive uppermost sack lies substantially flat for removal by filling spouts of said associated packer.

21. The method according to claim 15 further comprising transferring the bags located on said first bag transporting means to said second bag transporting means by automatically pushing at least one bag from the bag discharging position of said first bag transporting means towards the bag receiving position of said second bag transporting means.

22. The method according to claim 16 further comprising transferring at least one bag from said bag transporting means to said second bag transporting means by permitting at least one bat to slide on roller means from the discharging position of said first bag transporting means towards the bag receiving position of said second bag transporting means.

23. The method according to claim 16 further comprising retaining the bags on the supporting means of the substantially upright second bag transporting means while said supporting means pass around the lower end portion of the second bag transporting means.

24. A method for transferring bags such as sacks from a first supply position to a second position for removal thereof by filling spouts of a packing apparatus traversing a generally rotary path which comprises:

a. placing bundles comprising at least one bag on a first bag transporting means having a bag receiving position and a bag discharging position;
b. moving said bundles of bags along said first bag transporting means to the bag discharging position;
c. transferring said bundles of bags from the discharging position of said first bag transporting means to said second substantially upright bag transporting means when said second bag transporting means is in a bag receiving position;
d. positioning said bags so received in generally upright stacked relation;
e. detecting deviations of the height of said stack of bags resulting from the successive removal of each uppermost bag from said stack by filling spouts associated with an associated packing means;
f. activating said second bag transporting means in response to a signal provided when the height of said stack of bags is outside of a predetermined range; and
g. activating said first bag transporting means to move to a bag discharging position in dependent response to the assumption by said second bag transporting means of a predetermined bag receiving position 25. A method for transferring valve sacks from a first supply position to a second position for removal thereof by filling spouts of a packing apparatus traversing a generally rotary path which comprises:

a. successively feeding at least one bundle of sacks onto a first generally horizontal conveyor belt having a sack receiving position and a sack discharging position and having support members arranged generally transversely of the direction of movement of the belt for supporting the sacks in position thereon;
b. conveying each bundle thus received on said first conveyor belt to its sack discharging position;
c. transferring each bundle of sacks on said first conveyor belt to a second conveyor belt by automatically pushing by hydraulically or pneumatically activated pushing means, at least one sack from the sack discharging position of said first conveyor belt to a bag receiving position of said second conveyor belt, said second conveyor belt being generally upright and having means thereon to support bundles of bags transferred from said first conveyor belt;
d. positioning said sacks so received by said second conveyor belt in generally upright stacked relation;
e. detecting deviations of the height of said stack of sacks resulting from the successive removal of each uppermost sack from the stack of sacks by filling spouts connected to said packing apparatus;
f. activating said second conveyor belt in response to signals transmitted by means for detecting said deviation in the height of said stack of sacks; and
g. activating said first sack transporting means to move to a sack discharging position in dependent response to the assumption by said second conveyor belt of a predetermined sack receiving position.

* * * * *